US008696074B2

(12) United States Patent
Romaen et al.

(10) Patent No.: US 8,696,074 B2
(45) Date of Patent: Apr. 15, 2014

(54) SAFETY LOCK SYSTEM FOR CABINET DRAWERS

(76) Inventors: Andrew Romaen, Chicago, IL (US); Edward Karl Freimuth, Palos Heights, IL (US)

( * ) Notice: Subject to any disclaimer, the term of this patent is extended or adjusted under 35 U.S.C. 154(b) by 633 days.

(21) Appl. No.: 12/272,491

(22) Filed: Nov. 17, 2008

(65) Prior Publication Data

US 2010/0123375 A1 May 20, 2010

(51) Int. Cl.
*E05C 7/06* (2006.01)

(52) U.S. Cl.
USPC ..... 312/221; 312/215; 312/222

(58) Field of Classification Search
USPC ..... 312/215–218, 221, 222, 333, 107.5, 312/219, 220; 70/78–82, 85–87
See application file for complete search history.

(56) References Cited

U.S. PATENT DOCUMENTS 3,404,929 A * 10/1968 Wright et al. ..... 312/216
4,355,851 A 10/1982 Slusser
4,820,002 A * 4/1989 Lechner et al. ..... 312/221
4,865,404 A * 9/1989 Harper ..... 312/221
5,411,327 A * 5/1995 Norton ..... 312/221
5,599,077 A * 2/1997 Law et al. ..... 312/221
5,599,078 A 2/1997 Dechene et al.
5,605,388 A 2/1997 Laakso
5,685,622 A 11/1997 Laakso
5,829,859 A * 11/1998 Cram ..... 312/221
6,186,606 B1 * 2/2001 Krei ..... 312/221
6,227,507 B1 * 5/2001 Kallio ..... 248/250
6,296,332 B1 * 10/2001 Lammens ..... 312/217
6,409,290 B1 6/2002 Lin
6,450,596 B1 9/2002 Lee
6,615,993 B1 9/2003 Rudiger
6,634,726 B1 10/2003 Silvon
6,641,236 B2 11/2003 Grudzien
6,722,749 B1 4/2004 Pagac
6,726,294 B1 4/2004 Muller et al.
6,726,397 B2 4/2004 Kuehn et al.
6,779,855 B2 8/2004 Hoffman
6,966,619 B2 11/2005 Muller
6,979,064 B2 12/2005 Chiu
7,063,398 B2 6/2006 Hoffman
7,104,619 B2 9/2006 Ludwig et al.
7,156,244 B1 1/2007 Nelsen
7,185,959 B2 3/2007 Mueller et al.

* cited by examiner

*Primary Examiner* — Darnell Jayne
*Assistant Examiner* — Sasha T Varghese

(57) ABSTRACT

A safety lock system for cabinet drawers that provides a lock mechanism that in a locked position prevents any drawer from opening and in an unlocked position allows only one drawer to be opened at any one time. The system includes a slide wedge-ended member attached to each drawer, an inner cabinet wall and a support member both of which include vertically aligned T-shaped slots for receiving interlock pieces. Each interlock piece includes an upper protrusion and a lower protrusion and a spacer bar connecting the two protrusions.

16 Claims, 13 Drawing Sheets

SAFETY LOCK SYSTEM FOR CABINET DRAWERS

BACKGROUND OF THE INVENTION

The present invention relates to filing cabinets, and more particularly to mechanisms designed to prevent more than one drawer in a filing cabinet from being opened.

Filing cabinets and containers containing tow or more drawers are used to store items, documents, heavy files, tools, supplies, and other materials. In some instances, the opening of two drawers or more in such a cabinet at the same time can cause the cabinet to tip over and possibly cause serious injury to someone or damage to the items stored in the cabinet. In order to prevent the simultaneous opening of two drawers of such a cabinet and prevent the tipping over of the cabinet, the present invention provides a systemized mechanism where space limitations are a vital concern. The present invention is provided with an interlocking mechanism preventing a second drawer of the cabinet from being opened after a first drawer has been opened.

The present invention is also unique in that the cabinet can be designed with different sections, such as a top section with drawers and a bottom section with drawers, or left-hand side with drawers and right-hand side with drawers. The present invention then provides for the ability that each section could have a single drawer opened, while the other remaining drawers stay locked.

Filing cabinets are most often equipped with locks preventing any drawers from being opened. The lock is moved to a locking or closed position. The lock overrides any system designed to allow movement in a cabinet. In the prior art interlocking systems when the lock is activated no drawers can be opened at all. In the prior art cabinets, the lock must be activated or moved to a certain position to allow a drawer to open. The prior art interlock system functions to prevent the drawers from opening or only allowing one drawer to be opened where the lock is set to a certain position.

A system of locking all of the drawers and having an interlocking system that locks all but one of the drawers where space is a vital concern has not been developed until the present invention. The present invention provides for a significant number of components to be integrated and functionally combined to significantly reduce the space requirements and thereby reduce the weight of the cabinet. The present inventive cabinet combines an interlocking system with a locking mechanism so spatial constraints in the cabinet are not an impediment, and the present invention allows for the opening of a single drawer, if desired, in the cabinet without having to adjust the locking mechanism.

As noted, the current methods employed in cabinets or containers utilized today do not solve the issue of space limitations. Further, the reduction in parts, and therefore the reduced cost in production, in conjunction with the integration of common elements utilized in the locking system and the interlocking system of the cabinet or container provide significant cost reductions. By utilizing common parts, the reduction in breakage in the number of components is reduced, and a reduction in the weight of the cabinet is a result. Therefore, the reduction in components provides for easier and better mobilization of the cabinet, and a greater use of the storage space in a cabinet or container than was previously available.

Additionally, one of the other advantages of the present invention is a set of top drawers can be isolated or controlled from a bottom set of drawers allowing a single drawer to open from the different sections of the cabinet whether an upper or lower section of the cabinet. It should also be apparent that the present invention could be manufactured to allow for control of opening of a single drawer from a right-hand section of the cabinet or container and the opening of a single drawer from a left hand section of the cabinet or container.

As noted above, the locking and interlocking mechanisms known in the prior art have suffered from a number of disadvantages. A particular disadvantage is that many of these systems are complicated, and require complicated assembly and parts, with significant space requirements. For example, U.S. Pat. No. 4,355,851 is directed to a file cabinet including slidably mounted drawers, provided with an interlock mechanism preventing the simultaneous opening of two drawers. The interlock mechanism includes an elongated channel having a fixed length and depth. Blocks and wedges are slidable within the channel along the length thereof. This system further includes and requires a cam means and an actuator for forcing wedges into the channel.

Many systems are designed to prevent a second drawer from opening when a first drawer is already open, however, none has the added flexibility noted above of controlling sections of the drawers and allowing if desired, only a single drawer to open for that particular section.

In light of the foregoing, the desirability of combining an interlocking and locking system to overcome the prior art disadvantages and space limitation can be seen in the present invention.

SUMMARY OF THE INVENTION

The present invention provides a multi-drawer cabinet having an interlock mechanism preventing two or more drawers from being simultaneously opened. The present invention provides or allows if desired the opening of only one drawer, or if the cabinet or container is sectioned, the allowance of only a single drawer to be opened in that particular section. In addition, the following system is based on a minimal number of components of relatively easy design and assembly and employed where space is a major limitation in the cabinet housing.

The cabinet interlocking system is designed for multi-drawer cabinets. The cabinet or container interlock system includes a cabinet frame, with the usual drawer housing, and a vertical support member on an inner side panel of the cabinet. The vertical support member has slots for supporting interlock pieces. The interlock pieces are vertically stacked and member portions of the piece protrude through the slots, while the remaining portion of the interlock piece serves to space the protruding member portions of other interlocking pieces.

Two protruding members, attached to different spacers of different interlocking pieces are arranged in two slots, as a 'protrusion pair', with one protrusion of the pair resting upon the other. Each drawer has a wedge-ended member attached horizontally to a side of the drawer. The wedge-ended members are positioned to penetrate between a set of protrusions pair of interlock pieces when the drawer is opened. Only the locking interlocking members located above the opened drawer are displaced. The bottom interlocking members are not displaced on the drawers that remain closed below the opened drawer. The wedge-ended members exit from between the interlock pieces when the drawer is closed. As the wedge-ended member penetrates the vertically stacked interlock pieces, it causes only the locking members of the interlocking pieces located above the opened drawer to be displaced vertically by the width of the wedge-ended member.

Thus, this system provides a spring load to cause the displaced interlocking pieces to return to a neutral position.

The system load includes a spring; the spring helps in returning the interlocking piece members to the correct position. The spring constantly pushes down. Therefore the interlocking pieces are in vertical alignment, and the spatial constraints prevent them from being vertically displaced by more than by one drawer. Again, as noted above it is only the interlocking pieces located above the open drawer are displaced and keep the drawer from locking. In this way, two drawers can never be opened at the same time. As noted in a cabinet or container manufactured with specific sections the present invention allows a drawer from a designated top bank of drawers to be in the open position, while allowing a second opened drawer in a separate section of drawers from a bottom bank of drawers to be opened at the same time if desired. Any additional drawers would not be able to open. The cabinet interlock system of the present invention includes an interlocking bar in an alternative embodiment. The spring at the top of the vertical stack of interlock pieces constantly pushes down to hold the pieces in alignment and the spatial constraint of the cabinet prevents displacement of the interlock pieces by locking the interlock piece closest to the spring in a non-displaced position. A locking bar passes through the vertical support member and into a hollow in the interlock piece closest to the spring. This prevents any drawers from being opened. These and other advantages of the invention will be further understood and appreciated by those skilled in the art by reference to the following written specification, claims, and appended drawings.

DESCRIPTION OF THE PREFERRED EMBODIMENTS

Referring to FIGS. 1*a* through 4*e*, the designated parts are numbered consistently throughout the figures and represent the same parts without repeating the specific designation.

Figure 1A:
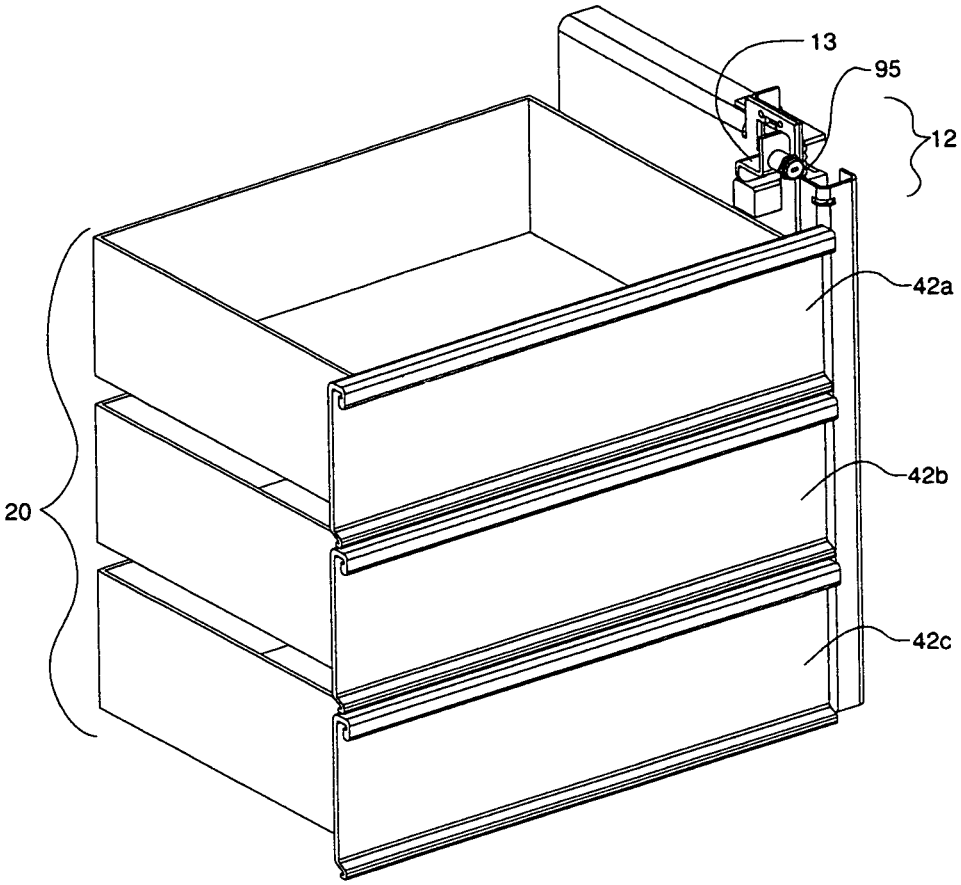
FIG. 1*a* is a perspective front view of three drawers of a cabinet in a closed position.

In FIG. 1*a*, a file cabinet drawer assembly 20 includes three drawers 42*a*, 42*b*, 42*c*, a lock bracket 13, and a key cylinder 95 for a lock mechanism 12.

Figure 1B:
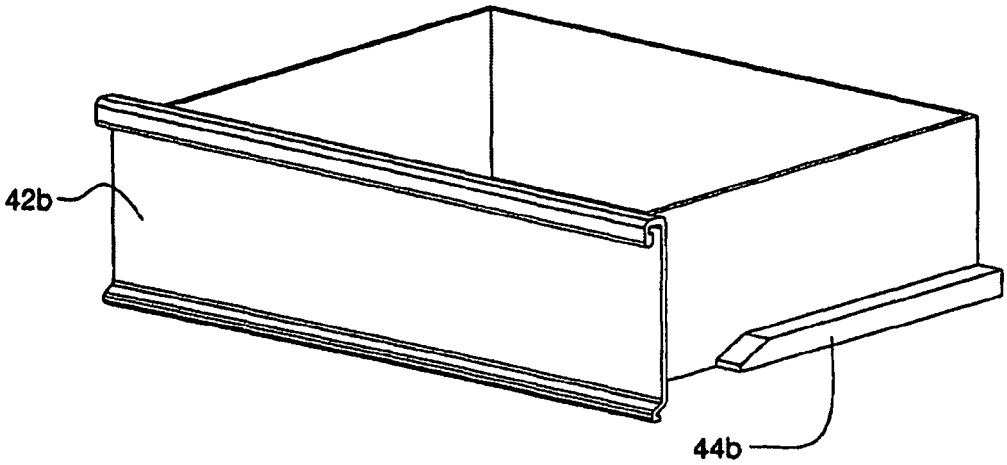
FIG. 1*b* is a perspective front view of a drawer with an attached wedge-ended member.
Figure 1C:
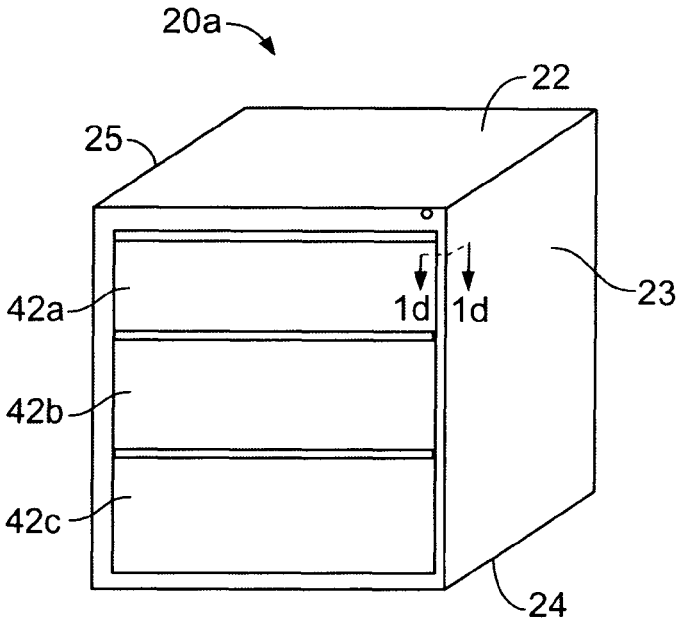
FIG. 1*c* is a perspective view of a tool cabinet that includes the three drawers shown in FIG. 1*a*.
Figure 2A:
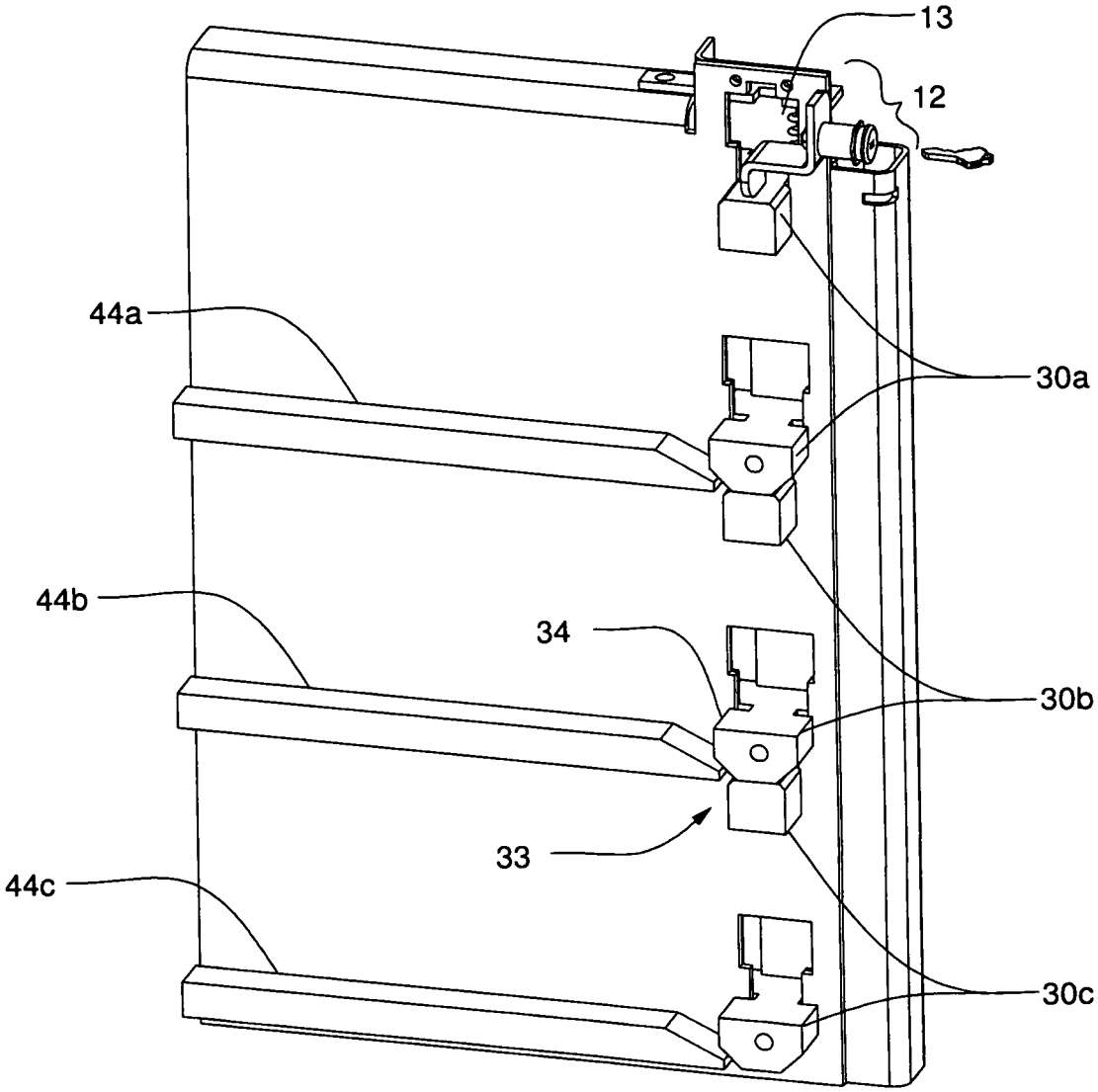
FIG. 2*a* is a perspective side view of the wedge-ended members and interlock pieces in a locked position.
Figure 2B:
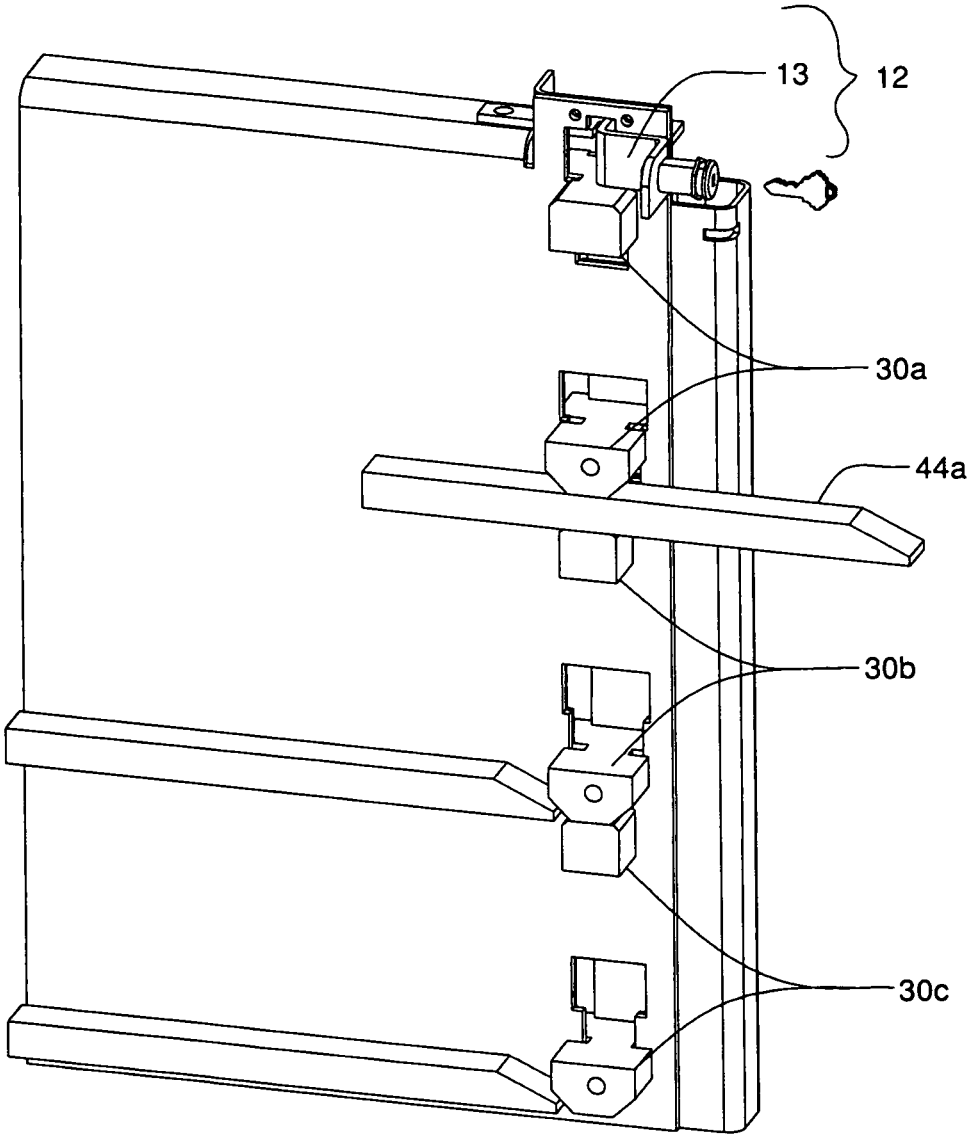
FIG. 2*b* is a perspective side view of the wedge-ended member inserted between two interlock pieces.

FIG. 1*b* illustrates a slide wedge ended member 44*b* attached to the drawer 42*b*. FIG. 2*a* illustrates a key for the lock mechanism 12 with the lock bracket 13 which acts with an upper protrusion of the pair 30*a* to lock a drawer slide wedge-ended member 44*a* from insertion between the lower protrusion of the pair 30*a* and the upper protrusion of the pair of protrusion 30*b*. FIG. 2*b* illustrates the lock bracket in an unlock position and the protrusion pairs 30*a* and 30*b* which are inserted in slots of an inner cabinet wall, engaged by the drawer slide wedge-ended member 44*a* to cause the two adjacent protrusions to be separated.

Figure 3A:
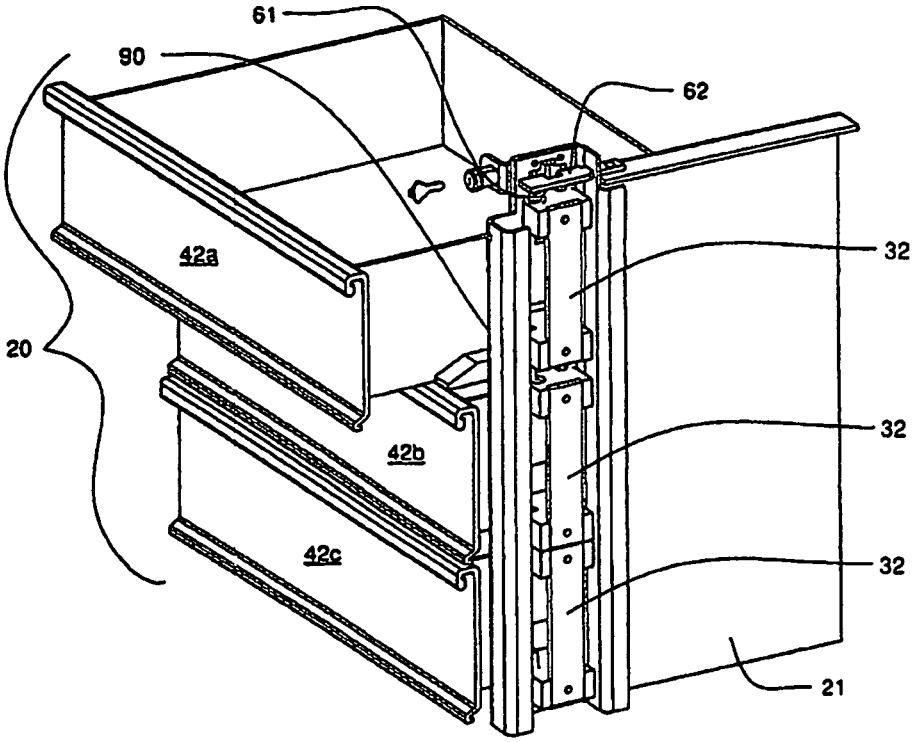
FIG. 3*a* is a reversed perspective side view of a vertical support member for the interlock system on an inner cabinet wall.
Figure 3B:
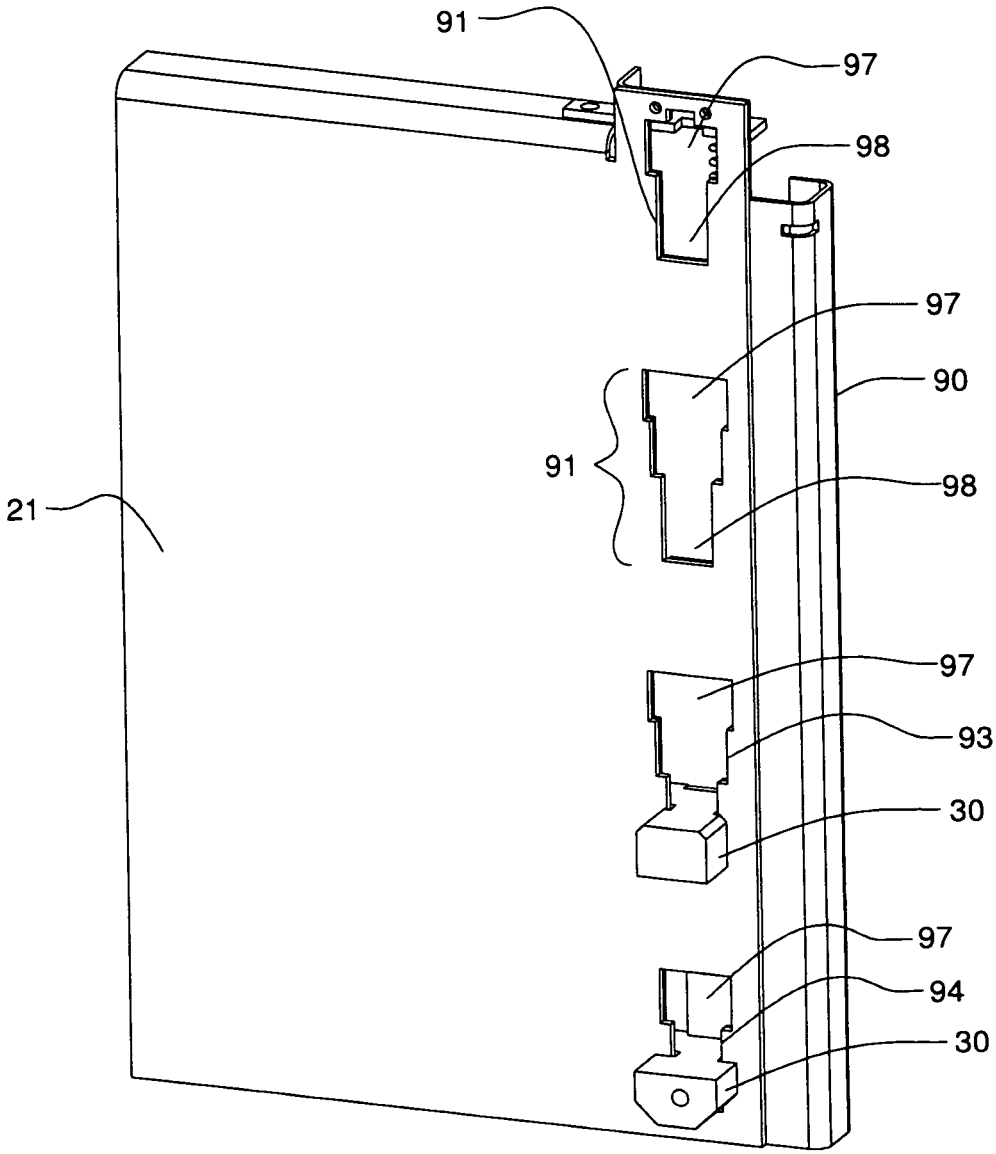
FIG. 3*b* is a perspective side view of the inner cabinet wall illustrating vertically aligned T-shaped slots.
Figure 3C:
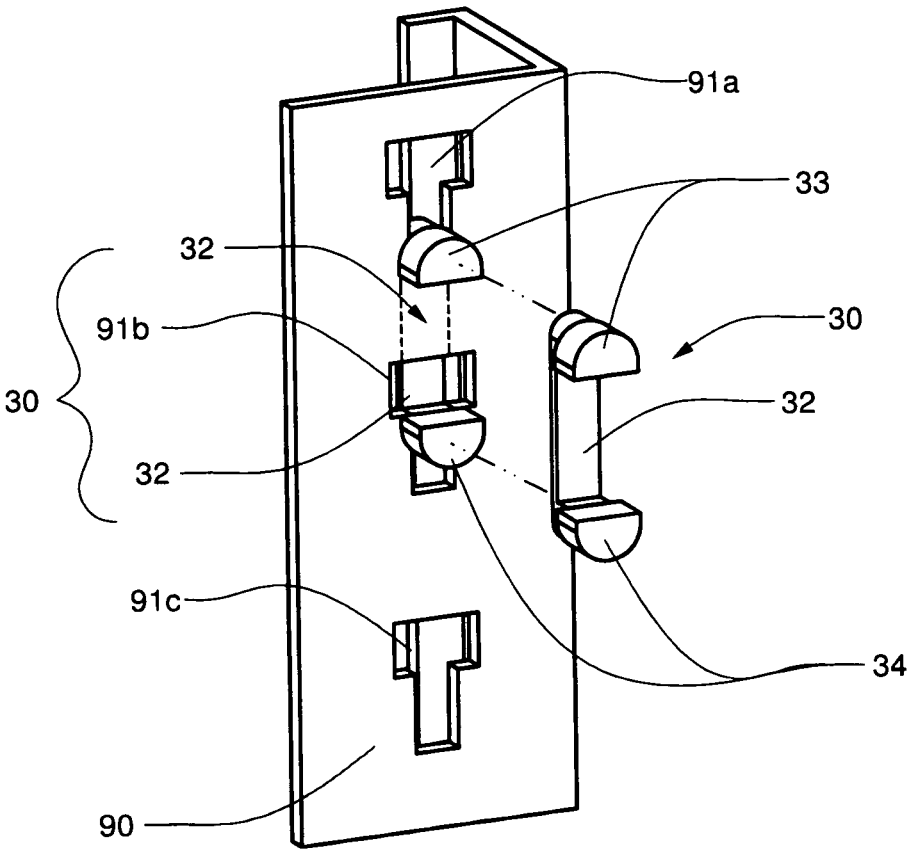
FIG. 3*c* is an enlarge perspective view of an interlock piece positioned in a support member.
Figure 4:
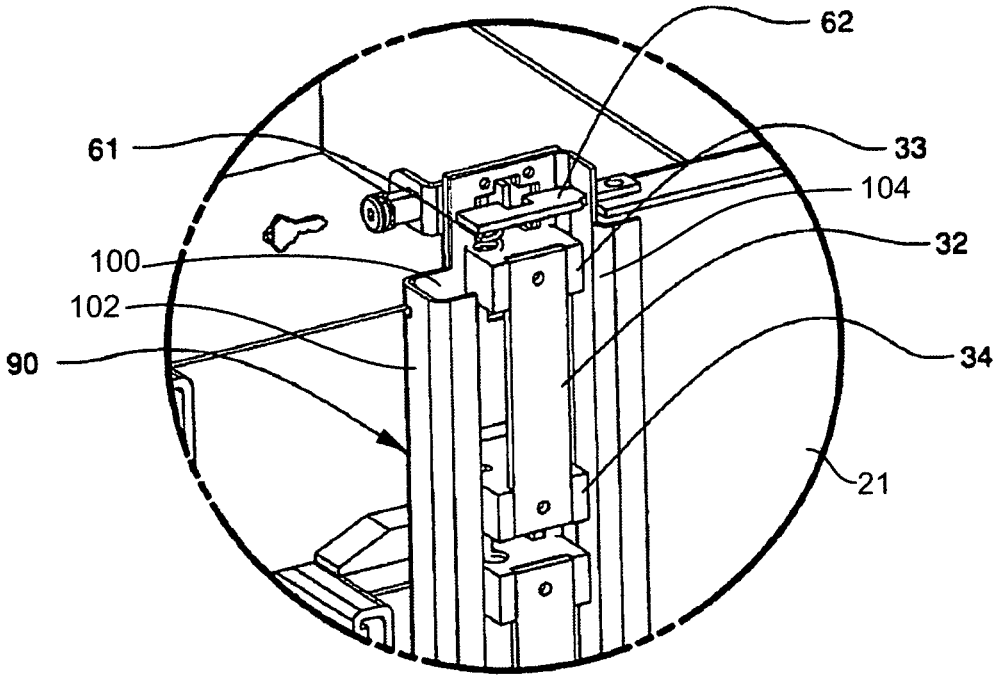
FIG. 4 is an enlarged perspective rear view of a spring, a spring plate and an interlock piece.
Figure 4A:
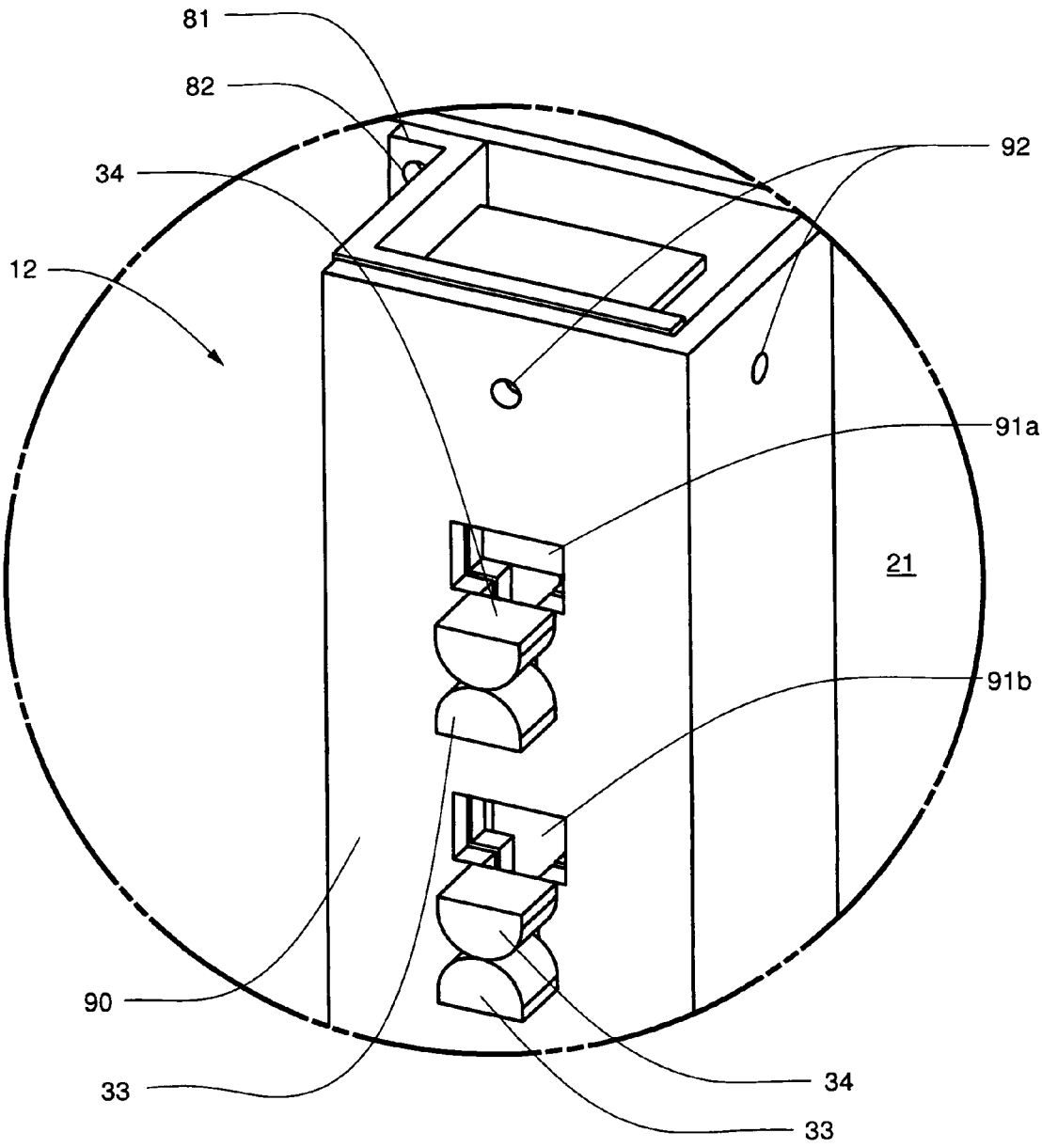
FIG. 4*a* is an enlarge perspective front view of support member and an interlock piece.

FIG. 3*a* illustrates the construction of the vertical support, the inner cabinet wall 21 of the cabinet drawer assembly 20, the drawers 42*a*, 42*b*, 42*c*, a spring 61, a spring plate 62, interlock spacers 32, three protrusion pairs and a vertical support member 90. FIG. 3*b* illustrates the T-shaped slots 91 consisting of stepped spaces 97, 98, 93 and 94 and the interlock piece of the protrusion pairs 30*c*. FIG. 3*c* details the method of inserting the interlock piece 30 having individual protrusions 33, 34 through slots 91*a*, 91*b*, and 91*c* in the vertical support member 90 where the individual protrusion pairs are connected by the interlock spacer 32. FIG. 4 illustrates the spring plate 62, the upper and lower protrusions 33 and 34, the interlock spacer 32, the spring 61 and the vertical support member 90. FIG. 4*a* illustrates further details of the interlock piece including protrusions 33 and 34 in the spaces 91*a* and 91*b* in the vertical column member 81 and screw holes 92 for support screws, such as the support screw 82, for connecting the vertical support member to the inner wall 21.

Figure 4B:
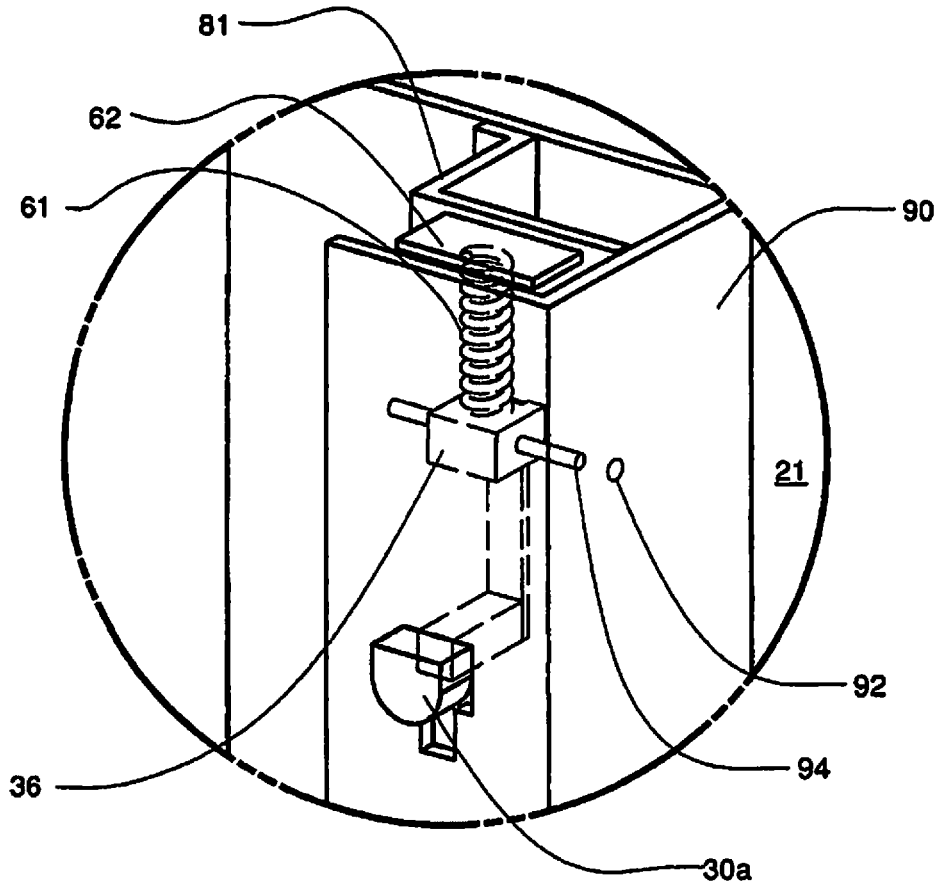
FIG. 4*b* is an enlarge perspective front view of the spring, the spring plate, and an alternative interlock piece.
Figure 4C:
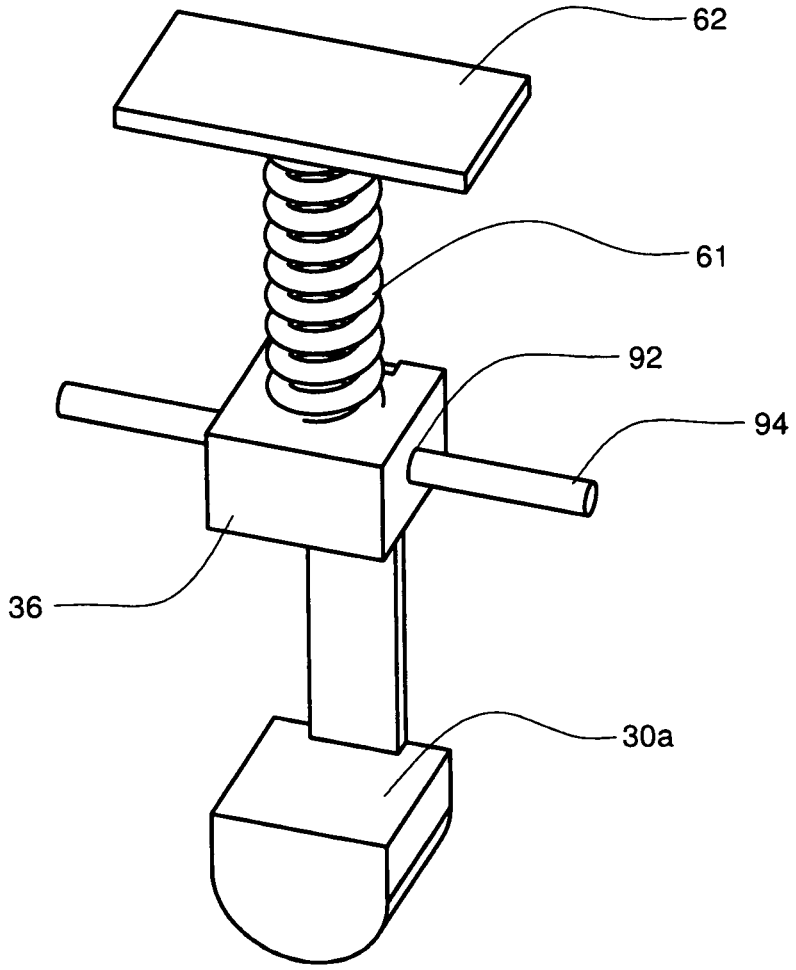
FIG. 4*c* is the alternative interlock piece shown in FIG. 4*b*.
Figure 4D:
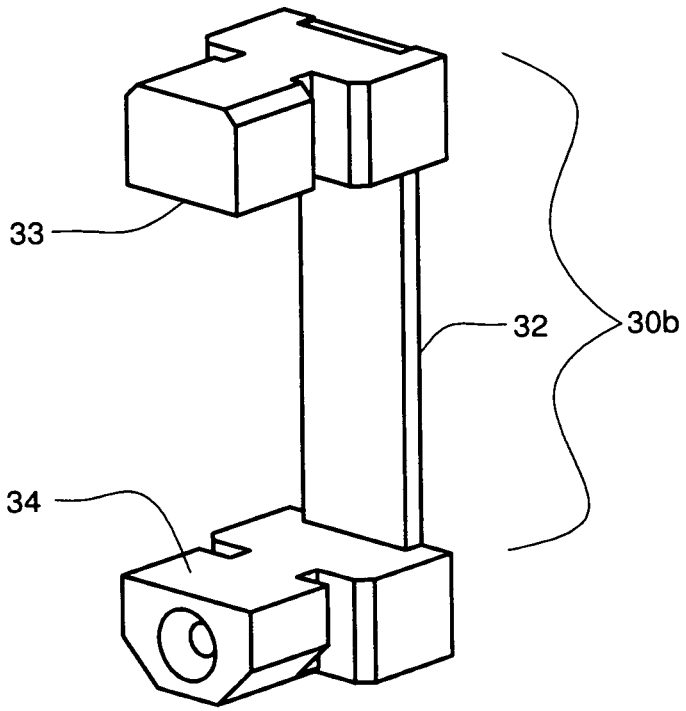
FIG. 4*d* is an enlarged front perspective view of the interlock piece shown in FIGS. 2*a*, 2*b*, 3*a*, 3*b*.
Figure 4E:
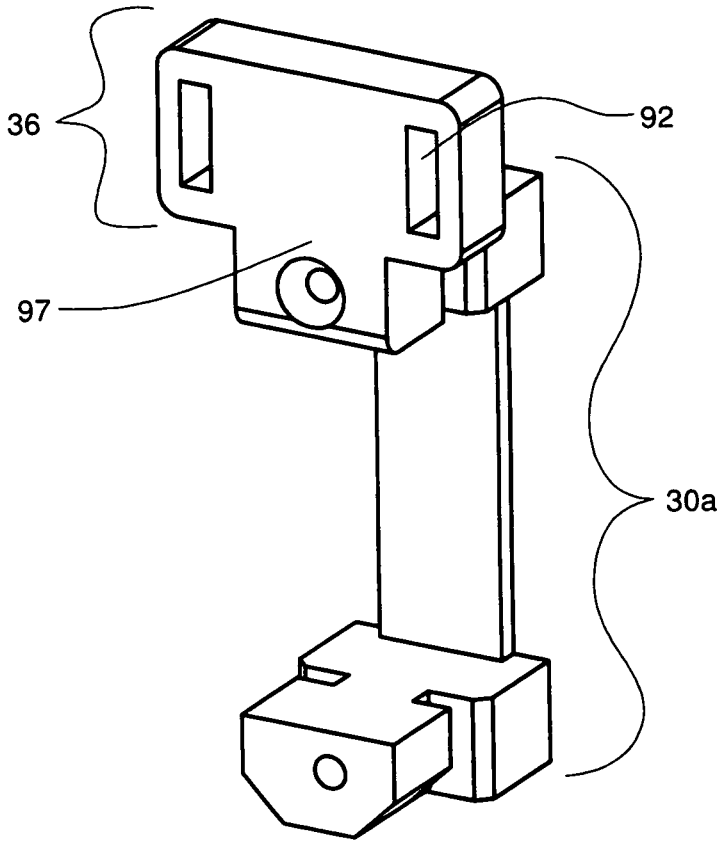
FIG. 4*e* is a front perspective view of another alternative interlock piece.

FIG. 4*b* repeats the previous designations of previous FIGS. 1-4*a* as does FIGS. 4*c*, and 4*d*. FIG. 4*e* illustrates an alternative embodiment of an interlock piece 30*a*, which engages an inserted lock bar in a slot 92 in an upper protrusion 97 of a support element 36.

DETAILED DESCRIPTION OF THE INVENTION

The present invention will now be described with reference to the accompanying drawings wherein the reference numerals in the following written description correspond to like numbered elements in the several drawings. The present invention relates to locks and interlocks used in file cabinets, tool cabinets, and other containers. A typical cabinet drawer assembly 20, showing the drawers 42*a*, 42*b*, 42*c*, is depicted in FIG. 1*a*. A cabinet 20*a*, FIG. 1*c*, includes the drawers 42*a*, 42*b*, and 42*c* mounted for sliding movement within the cabinet 20*a*, the cabinet being formed of an upper wall 22, a lower wall 24 (not shown), and a pair of sidewalls 23, 25 (of which only sidewall 23 is shown). Drawer slides (not shown), or equivalent mechanisms are interposed between the drawers 42*a*, 42*b*, 42*c* and the cabinet sidewalls 23, 25 or inner walls for providing sliding movement of the drawers 42*a*, 42*b*, and 42*c* between an open position and a closed position. While only three drawers are illustrated in the cabinet 20*a*, the present invention in applicable to cabinets having any number of drawers, including cabinets designed with sections of drawers.

The present invention includes a locking system with the ability to override the interlocking system. More specifically, when the locking system is activated, no drawers can be opened at any time. When the locking system is deactivated, the interlocking system is activated and the system prevents more than one drawer from being opened at a single time. The locking system may be activated by inserting a key into a keyhole 95 positioned at any suitable location on the file cabinet. The locking and interlocking systems are highly integrated so the components of the interlocking system are used in the locking system.

An interlock mechanism, shown generally at 12, is interposed between the cabinet structure, sidewall 23, and each of drawers 42*a*, 42*b*, and 42*c*. As will be explained, interlock mechanism 12 functions to prevent more than one of drawers 42*a*, 42*b*, and 42*c* from being opened at one time.

FIG. 1*b* shows drawer 42*b* and drawer slide wedge-ended member 44*b* has been attached to its side. Drawer slide wedge-ended member 44 can be of variable thickness for positioning relative to the drawer and is required to be accurately positioned relative to locking mechanism 12. Drawer slide wedge-ended member 44*b* is attached to drawer 42*b*.

Referring to FIG. 2*a*, drawer slide wedge-ended members 44*a*, 44*b*, 44*c* are depicted as they would be situated were they attached to closed drawers. With regard to interlock mechanism 12, interlock mechanism 12 includes a series of interlock pieces collectively, 30, separately 30*a*, 30*b*, and 30*c*, vertically stacked. Interlock pieces are shown, but the invention is not intended to be limited to any particular number of drawers.

In the FIG. 2*a*, alternative embodiment, it is noted interlock piece 30*a* comprises an upper protrusion, contact locking bracket 13. Three interlock pieces, see FIG. 4*d*, collectively 30, designated 30*a*, 30*b*, 30*c*, consist of a spacer 32, and two protrusion blocks, upper protrusion 33, and lower protrusion 34, a protrusion pair, 33, 34 of two interlocking pieces as shown in FIG. 2*a*. Interlock pieces are preferably formed of Delrin® (polyoxymethylene), or Nylatron® or any other suitably abrasion wear resistant material. The abrasion may be lubricated to reduce the friction caused by the movement of the components. The preferred material noted is one chosen because of ease to machine and reduction of contact friction between wedge-ended members 44*a*, 44*b*, 44*c*, and interlock pieces 30*a*, 30*b*, 30*c*. The present invention is not limited to this material and other materials may be utilized either in combination or separately. Each wedge-ended member 44 intersects two protrusion blocks, 33 and 34, a protrusion pair. As an example, FIG. 2*a*, drawer slide wedge shaped member 44*b* is disposed at the point of meeting between lower protrusion block 34 of interlock piece 30*b* and upper protrusion block 33 of interlock piece 30*c*. Again, the two meeting protrusions, 33 and 34, may be termed a 'protrusion pair', with one protrusion of the pair resting upon the other. The vertical stack of interlock pieces can be said to be composed of a number of protrusion pairs, separated by spacers.

Each drawer has a drawer slide wedge-ended member attached horizontally to a side of the drawer. The wedge-ended members, collectively 44, individually 44*a*, 44*b*, and 44*c* are positioned to penetrate between a protrusion block pair of interlock pieces, collectively 30, individually 30*a*, 30*b*, and 30*c* when the drawer is opened. Drawer slide wedge-ended members exit from between the interlock pieces when the drawer is closed. As the drawer slide wedge-ended member penetrates the vertically stacked interlock block pieces, it causes them to displace vertically by the width of the wedge-ended member. Only the pieces immediately above the drawer to be opened are displaced vertically.

To help wedge-ended members 44 to penetrate between interlock pieces 30, and to reduce friction and wear and tear, it is recommended the sections of interlock pieces 30 adjacent to the wedge-shaped members' entry point be domed, or tapered. Thus, each protrusion pair consists of a higher protrusion 33, and a lower protrusion 34. The higher protrusion 33 of the pair consists of a flat upper profile with a tapered lower profile. The lower protrusion 34 of the pair has a flat upper profile and a tapered lower profile. A 'tapered profile' includes a discrete number of straight sides, or a rounded or domed profile, to promote penetration of said wedge-ended member. The protrusion pair consists of lower protrusion 34 of an interlocking piece 30 and the upper protrusion 33 of a separate interlocking piece 30 to form a protrusion pair with a higher and a lower protrusion.

Drawer slide wedge-ended members 44 have a long lower edge versus a shorter upper edge, forming a prolonged triangular presentation. This provides for easier penetration of the stack of interlock pieces 30. Prolonged lower edge of wedge-ended members 44 eases the meeting point of each protrusion pair.

The various interlock pieces, collectively 30, are not joined to one another but are stacked and held in vertical alignment. Spring loading means 61, 62 is attached to the top of the vertical stack. Spring loading means 61, 62 can alternatively be attached to the base of the stack, or to the middle of the vertical stack of interlock pieces 30*a*, 30*b*, 30*c*. Spring loading means 61, 62 helps in returning the stack to the neutral or closed position, and the stack of interlock pieces 30*a*,30*b*, and 30*c* only requires a small displacement accordingly, substantially equal to the width of wedge-ended member 44*a*, 44*b*, or 44*c*, so one wedge-ended member 44*a*, 44*b*, or 44*c* penetrates through the stack. The limited displacement effectively means two different drawers cannot be simultaneously opened, and a second drawer cannot be opened if a different one is already open.

In an alternate embodiment, top interlock piece 36 is unique in FIG. 4*b*. It is closest to the spring load means 61, 62. It does not include an upper protrusion 33 positioned opposite a wedge-ended member 44, since its lower protrusion 30*a* is positioned opposite the top most drawer wedge-ended member 44*a*. However, top interlock piece 36 may include instead a key-locking mechanism bar locking mechanism. In an alternate embodiment, the locking mechanism is in the form of a hollow 92 in interlock 36 allowing the insertion of a locking bar from the side or front wall of the cabinet. Bottom interlock piece 30 may also be manufactured slightly differently from the other interlock pieces 30 depending on design considerations; for example, it may not require its lower protrusion 34, other than to wedge into position. Therefore, in a further embodiment, bottom interlock piece 34 may be fixedly attached into position.

In a preferred embodiment, FIG. 2*b* shows locking system 12 with wedge-ended member 44*a* inserted amidst the stack of interlock pieces 30*a*, 30*b*, 30*c*, indicating the first drawer has been opened. As may be seen, interlock piece 30*a* above wedge-ended member 44*a* has been displaced upwards against the spring loading mechanism 61, 62, which is fully compressed. Interlock pieces below member 44*a* have not moved at all.

With reference now to FIG. 3*a*, a vertical support member 90 for the interlock system 12 is depicted. A vertical support member is part of or attached to inner wall 21 of cabinet 20, the same wall as outer wall 23. The vertical support member provides guiding support for the vertical stack of interlock pieces, and in a preferred embodiment incorporates T shaped slots 91 to support the interlock pieces. The invention is not limited to T shaped slots 91 slots of different shapes and sizes may be utilized. T shaped slot 91 shown in FIG. 3*b* is depicted as divided into two distinct and mutually exclusive sections, horizontal sections 97 and 93, and vertical sections 98, and 94. In reality, T shaped slot 91 is not divided at all, but for clarity they are described as if they contain several sections. The benefit of the T shaped slot(s) 91 is the interlock pieces may be inserted into the horizontal section 97 of the T shaped slot(s) 91, and then dropped down to a narrow vertical lower section 98. In vertical section 98, the interlock piece cannot move from side to side. In addition, vertical section 98 is high enough that even at maximum displacement of operational usage, the interlock pieces will not rise high enough to reach horizontal section 97, thus they remain properly confined. Hence, the spatial restraint of the interior of the cabinet frame helps in channeling the displacement of the interlocking mechanism, and provides for allowing only one drawer to be opened in a cabinet or section of a cabinet if so desired. Although the slots are referred to as T shaped, this description is intended to include the possibility that the horizontal section of the T shaped slots may be rounded. Again, the T configuration is not the only available configuration to provide the necessary support and configuration for locking the appropriate component.

Figure 1D:
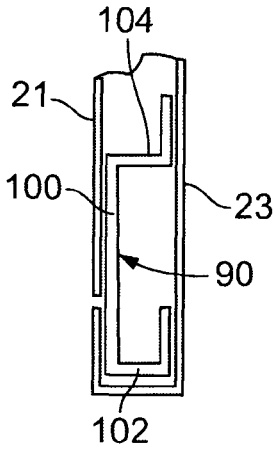
FIG. 1 *d* is a section view taken along line 1*d*-1*d* of FIG. 1*c*, but without interlocking pieces.

The support member 90, FIGS. 1*d* and 4, includes a base portion 100, a first or forward L-shaped portion 102 and a second or rearward L-shaped portion 104. The forward and rearward L-shaped portions 102, 104 are parallel to one another as shown and extend from the base portion 100, also as shown.

FIG. 3*c* depicts an inserted sample interlock piece 30 as it would appear once inserted into T shaped slots 91*a* and 91*b*. To insert sample interlock piece 30 into the T shaped slots, sample interlock piece 30 is held from behind vertical support member 90. Upper protrusion 33 is inserted towards the viewer into the horizontal section of the T shaped slot 91*a* whilst lower protrusion 34 is inserted into the horizontal section of T shaped slot 91*b*. Sample interlock piece 30 is then allowed to drop down, so that upper protrusion 33 hangs from the base of the vertical section of T shaped slot 91*a*, while lower protrusion 34 does not reach the base of the horizontal section of T shaped slot 91*b*. It would instead rest on a lower interlock piece. To set up interlock device 12 it is recommended to start with the lowest interlock piece 30, and then insert all of them, finishing with the spring load at the top. Spacer 32 is shown indistinctly because much of it is behind vertical support member 90, although part of it is visible behind T shaped slot 91*b*.

FIG. 4 shows locking spring 61 and interlock spaces 32. FIG. 4*a* shows a locking bar interlock, system 12 attached to cabinet wall 21. Interlock pieces 33 and 34, 30*c* are visible through T shaped slots 91*a* and 91*b*. FIG. 4*a* shows an additional vertical column member 81 removably attached, by screws 82 or other equivalent mechanisms onto cabinet wall 21. Vertical column member 81 serves to protect interlock pieces 30 from being thrust towards cabinet wall 21. The vertical column member prevents internal slippage of interlock pieces 30 if the filing cabinet is improperly handled. A further alternate embodiment of the present invention is provided in FIG. 4*e*, a locking bar is inserted into hollow 92.

FIG. 4*b* shows further details of FIG. 4*a* with regard to spring loading 61, 62 and interlock piece 30*a*. Spring 61 is compressed against plate 62 as interlock piece 30*a* is raised. The interlock system 12 could equally well work upside down, if spring loading 61, 62 were to be alternatively placed under the lowest interlock piece 30. For clarity, the present disclosure was limited to descriptions utilizing upward displacement. Downward displacement is equally anticipated.

FIG. 4*c* depicts further details of the alternate locking bar system, which could use any locking mechanism known in the art. In an alternative embodiment, FIG. 4*e*, the top section 36 of topmost interlock piece 30*a* is formed as a block containing a hollow 92, into which locking bar 94 (not shown) is inserted when it is desired to deactivate the spring and prevent any displacement of the interlock pieces 30. This effectively stops all the drawers from opening. This locking procedure can only be effective if done when all the drawers are initially closed. The locking bar 94 prevents the spring 61 from being compressed and therefore wedge-ended members are prevented from penetrating the series of interlock pieces 30. Since they cannot penetrate, the drawers are unable to open.

FIG. 4*e* depicts the locking bar. FIG. 4*e* further depicts an alternative locking bar top section 36 of topmost interlock piece 30*a* containing a rectangular receptacle for a rectangular shaped locking bar.

The locking system alternatively includes a keyhole and a key, in which the key is operationally connected to the locking device, such as locking bracket 13. The turning of the key in the keyhole causes the locking mechanism to be activated, such as inserting locking bracket 13 over protrusion block 33 of interlock 33*a*. The present invention further provides a method for building the cabinet of the present invention, in which no more than one drawer can be opened at any given time.

A number of stages are involved:

Providing a filing cabinet frame with a vertical member on an inner side surface of the filing cabinet;

i) attaching a wedge-ended horizontal bar to each of the drawers;

ii) producing T shaped slots on a face of the vertical member facing the drawers;

iii) inserting the top end of a first interlock piece and the bottom end of a second interlock piece into each T shaped slot from behind the slot so protrusions of the interlock pieces protrude towards the drawer spacers of the interlock pieces remain behind the vertical member;

iv) spring loading the interlock pieces so there is a constant downward push to substantially the width of a single wedge-ended horizontal bar;

v) positioning the slots so all the interlock pieces are arranged in a vertically contacting pile so when a drawer is opened, a wedge-ended horizontal bar displaces the molded interlock pieces between the horizontal bar by the width of the horizontal bar; optionally vi) locking the cabinet by inserting a locking bar into the interlocking pieces closest to the spring load whilst the spring load is fully extended in an alternate locking procedure;

vii) locking the cabinet by turning a key in a keyhole, the key connected to a locking bracket, which on being turned over protrusion 33 of interlock piece 30 *a* locks the locking system in an alternate locking procedure.

While the present invention has been described in terms of the preferred embodiments depicted in the drawings and discussed in the above specification, it will be understood by one skilled in the art that the present invention is not limited to these particular preferred embodiments, but includes any and all such modifications that are within the spirit and scope of the present invention as defined in the following claims.

The invention claimed is:

1. A safety lock system for cabinet drawers comprising:

a cabinet;

a plurality of cabinet drawers adapted to slide in and out of the cabinet, each of said plurality of drawers having a wedge-ended member attached thereto;

an inner wall of the cabinet having a plurality of vertically aligned and enclosed T-shaped slots equal in number to the plurality of cabinet drawers;

a support member having a plurality of vertically aligned and enclosed T-shaped slots, the support member being mounted to the inner wall;

a plurality of interlock pieces vertically arranged, the interlock pieces being mounted to the support member and extending into the T-shaped slots of the inner wall and the support member, each interlock piece having an upper protrusion and a lower protrusion mounted to a spacer bar, the protrusions being spaced to operatively engage the wedge-ended members; and a key operated lock mechanism having a movable bracket, the bracket being mounted to engage the upper protrusion of the uppermost one of the interlock pieces.

2. The safety lock system for cabinet drawers of claim 1, wherein:

the uppermost T-shaped slots of the inner wall and the support member each receive the upper protrusion of the uppermost interlock piece;

the second to uppermost T-shaped slots of the inner wall and the support member each receive the lower protrusion of the uppermost interlock piece and the upper protrusion of the second to uppermost interlock piece of the vertically arranged interlock pieces; and the third uppermost T-shaped slots of the inner wall and the support member each receive a lower protrusion of the second to uppermost interlock piece and an upper protrusion of the third to uppermost interlock piece of the vertically arranged interlock pieces.

3. The safety lock system for cabinet drawers of claim 1 wherein:

each T-shaped slot is sufficiently long vertically to receive two protrusions and a distance equal to the height dimension of a wedge-ended member.

4. The safety lock system for cabinet drawers of claim 1 wherein:

each lower protrusion includes three surfaces, a horizontal surface and two bordering slanted surfaces.

5. The safety lock system for cabinet drawers of claim 1, wherein:

each wedge-ended member includes a slanted leading edge.

6. The safety lock system for cabinet drawers of claim 1, wherein:

the bracket of the lock mechanism has two positions, a first locking position extending a distance equal to the height dimension of a wedge-ended member and a second unlocked position extending so as to leave a gap equal to the height dimension of a wedge-ended member.

7. The safety lock system for cabinet drawers of claim 1, wherein:

the bracket of the lock mechanism is movable between locked and unlocked positions, wherein in the locked position the bracket bears against the upper protrusion of the uppermost interlock piece of the vertically arranged interlock pieces and in the unlocked position the bracket moves a distance equal to the height dimension of a wedge-ended member.

8. The safety lock system for cabinet drawers of claim 1, including:

a biasing spring for bearing on the upper protrusion of the uppermost interlock piece.

9. The safety lock system for cabinet drawers of claim 1, wherein:

each T-shaped slot includes an upper section of greater width and a lower section of lesser width; and each T-shaped slot prevents side to side motion of an upper protrusion of an interlock piece located in the lower section of the T-shaped slot.

10. The safety lock system for cabinet drawers of claim 1, wherein:

the uppermost T-shaped slots of the inner wall and the support member each receive the upper protrusion of the uppermost interlock piece;

the second to uppermost T-shaped slots of the inner wall and the support member each receive the lower protrusion of the uppermost interlock piece and the upper protrusion of the second to uppermost interlock piece of the vertically arranged interlock pieces;

the third uppermost T-shaped slots of the inner wall and the support member each receive a lower protrusion of the second to uppermost interlock piece and an upper protrusion of the third to uppermost interlock piece of the vertically arranged interlock pieces; and each T-shaped slot is sufficiently long vertically to receive two protrusions and a distance equal to the height dimension of a wedge-ended member.

11. The safety lock system for cabinet drawers of claim 10 wherein:

each lower protrusion includes three surfaces, a horizontal surface and two bordering slanted surfaces; and each wedge-ended member includes a slanted leading edge.

12. The safety lock system for cabinet drawers of claim 11, wherein:

the bracket of the lock mechanism has two positions, a first locking position extending a distance equal to the height dimension of a wedge-ended member and a second unlocked position extending so as to leave a gap equal to the height dimension of a wedge-ended member; and in the locking position the bracket bears against the upper protrusion of the uppermost interlock piece of the vertically arranged interlock pieces.

13. The safety lock system for cabinet drawers of claim 12, wherein:

the uppermost T-shaped slots of the inner wall and the support member each receive the upper protrusion of the uppermost interlock piece;

the second to uppermost T-shaped slots of the inner wall and the support member each receive the lower protrusion of the uppermost interlock piece and the upper protrusion of the second to uppermost interlock piece of the vertically arranged interlock pieces; and the third uppermost T-shaped slots of the inner wall and the support member each receive a lower protrusion of the second to uppermost interlock piece and an upper protrusion of the third to uppermost interlock piece of the vertically arranged interlock pieces; and each T-shaped slot is sufficiently long vertically to receive two protrusions and a distance equal to the height dimension of a wedge-ended member.

14. The safety lock system for cabinet drawers of claim 13 wherein:

each lower protrusion includes three surfaces, a horizontal surface and two bordering slanted surfaces; and each wedge-ended member includes a slanted leading edge.

15. A safety lock system for drawers of a tool cabinet comprising:

a tool cabinet having a plurality of cabinet drawers, each drawer of the plurality of drawers having a wedge-ended member attached thereto, and the cabinet having outer sidewalls and an inner wall;

the inner wall of the cabinet having a plurality of vertically aligned slots;

a support member connected to the inner wall and disposed between the inner wall and one of the outer sidewalls, the support member having a base portion, and a plurality of vertically aligned slots in the base portion aligned with the slots of the inner wall;

a plurality of interlock pieces vertically arranged, the interlock pieces being mounted to the support member and having protrusions extending into the slots of the inner wall and the support member to enable engagement with the wedge-ended members;

a plate connected to the cabinet above the interlock pieces; and a spring mounted between the plate and the uppermost interlock piece of the plurality of interlock pieces.

16. The safety lock system for drawers of a tool cabinet as claimed in claim 15 including:

a key operated lock mechanism connected to the cabinet having a movable bracket, the bracket being mounted to engage a protrusion of the uppermost interlock piece of the plurality of interlock pieces.

* * * * *